US005246152A

United States Patent [19]

Dotseth

[11] Patent Number: 5,246,152

[45] Date of Patent: Sep. 21, 1993

[54] BABY CARRIER WITH HEAD SUPPORT

[76] Inventor: Junice A. Dotseth, P.O. Box 393, Marshall, Minn. 56258

[21] Appl. No.: 911,697

[22] Filed: Jul. 10, 1992

[51] Int. Cl.[5] ..... A61G 1/00

[52] U.S. Cl. ..... 224/159; 224/160; 224/158

[58] Field of Search ..... 224/159, 160, 161, 158, 224/201, 202, 204, 205, 207, 209, 210, 211, 212, 213, 214, 907

[56] References Cited

U.S. PATENT DOCUMENTS

| | | | |
|---|---|---|---|
| 3,780,919 | 12/1973 | Hansson | 224/160 |
| 4,271,998 | 12/1992 | Ruggiano | 224/160 |
| 4,428,514 | 1/1984 | Elf | 224/160 |
| 4,467,945 | 8/1984 | Schaapveld | 224/160 |
| 4,492,326 | 1/1985 | Storm | 224/160 |
| 5,020,709 | 6/1991 | Hoaglas | 224/160 |

*Primary Examiner*—Henry J. Recla
*Assistant Examiner*—David J. Walczak

[57] ABSTRACT

A baby carrier designed to be worn by an adult. Principally, the carrier would be worn in front, but it is also adapted for the back or side of the adult. The carrier includes a harness worn by the adult with an attached flap having leg openings for the child's legs. The flap is fixed to the harness at its lower edge and is releasably attached at the upper edge. A head rest for the baby is removably attached to the flap.

2 Claims, 1 Drawing Sheet

BABY CARRIER WITH HEAD SUPPORT

BACKGROUND AND SUMMARY OF THE INVENTION

This invention pertains to infant carriers of the type adapted to be worn by an adult and more particularly to such a carrier made of flexible fabric and having a separate head rest.

As mothers have become increasingly free from home chores and are able to get out into society, means for convenient carrying of infants have become popular. Those carriers often take the form of back pack devices and, more recently, similar devices adapted to hold the infant to the front of the adult doing the carrying.

Usually, the carrier includes openings for the legs of the infant, but except for that feature, there are no great variations. Some carriers are full pouch or pocket like carriers into which the infant is placed from above. Some are only strap type carriers. In nearly all carriers, the placement of the infant into the device safely and conveniently is of concern.

By the present invention, a carrier is provided in which the placement of the infant is relatively easy and safe because the back support for the infant is detachable and drops away while the infant is held. Further, a removable head rest for the infant is provided for safe support of the infant's head.

DESCRIPTION

Figure 1:
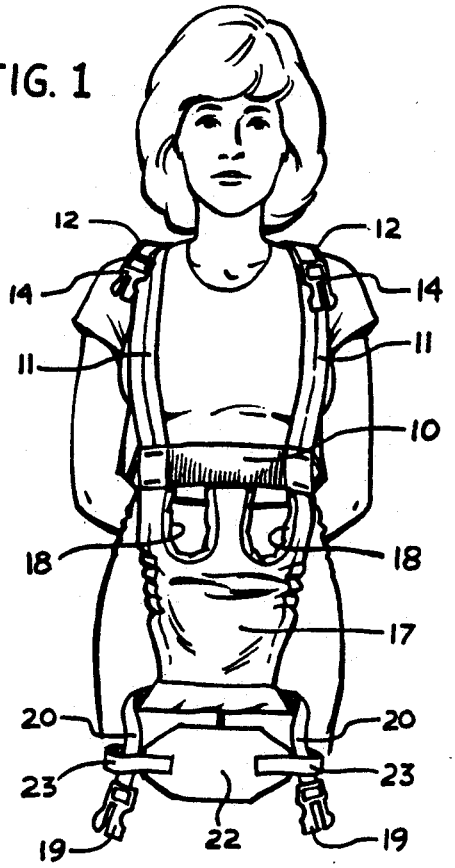
FIG. 1 is a front view of the carrier on an adult and ready to receive the baby.
Figure 2:
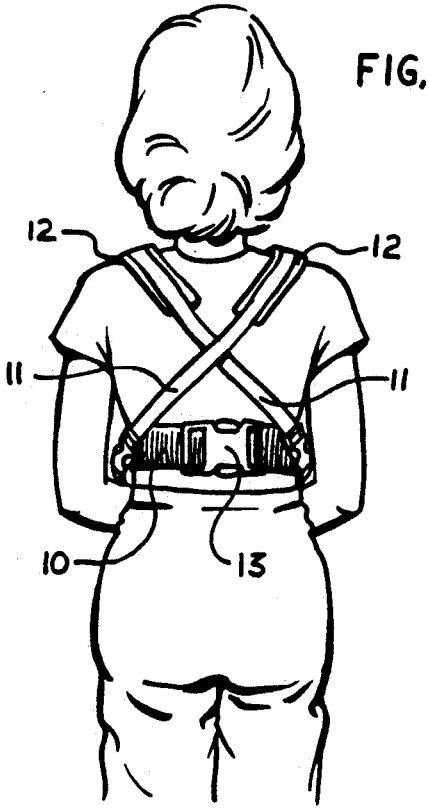
FIG. 2 is a rear view of the carrier on an adult.
Figure 3:
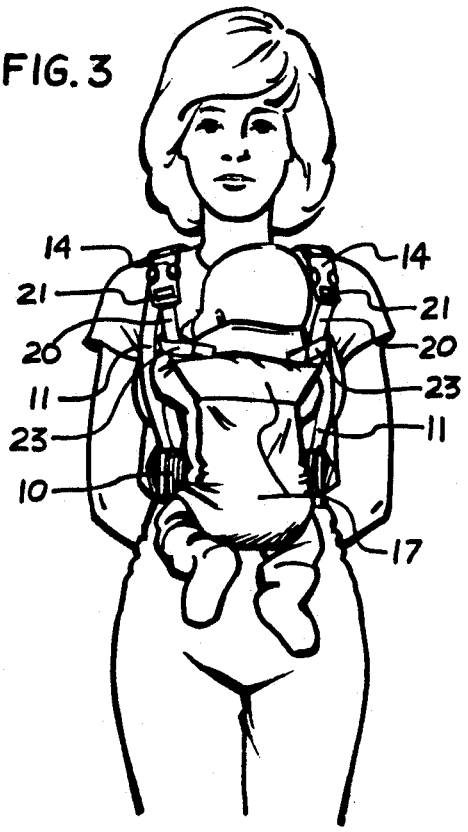
FIG. 3 is a front view of the carrier as worn by the adult with the infant in place.
Figure 4:
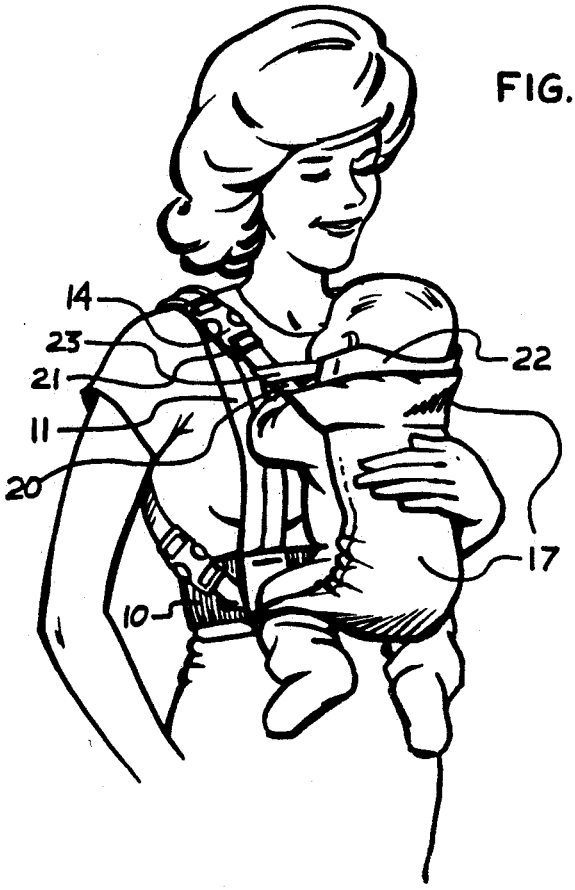
FIG. 4 is a view partially from the side showing the carrier with the infant as in FIG. 3.

Briefly this invention comprises a carrier to be worn by an adult and adapted to carry an infant. The carrier includes a flap-like piece adapted to be buckled up to hold the infant and a removable head support adapted to hold the infant's head.

More specifically and referring to the drawings, the carrier is worn by the adult principally as a harness. The harness includes a belt 10 around the waist of the adult. The first end of each of two straps 11 is fastened to the front of the belt. From there, the straps extend upwardly over the shoulders of the wearer. Beyond the shoulders, the straps 11 cross, and extend back to the belt to which the second end of each of the straps is fastened on a side of the wearer.

Shoulder pads 12 on the straps 11 may be used to spread the weight and reduce localized pressure on the shoulders. Also, a buckle 13 is used to fasten the belt and adjustable buckles 14 in the straps 11 or other adjusting devices may be used to provide proper fitting for the harness.

The carrier itself includes a flap 17 of fabric or the like fixed at one end to the belt 10. The flap is formed to provide leg openings 18 through which the legs of the infant may be inserted. The flap then is adapted to be held upright behind the infant's back by means of quick attaching devices 19 engaged between the buckles 14 on the harness straps 11 and a pair of support straps 20 on the flap 17. Adjustment devices 21 are also provided in the straps to adjust for varied size of the infant being carried.

The flap 17 is long enough to support the back of the infant and the baby's head in its early months. As the infant grows, the back will extend only a little or not at all above the child's shoulders. The reason for that length is to allow for more freedom of motion as the child achieves muscular control of the head position. However, when the infant is young or has a muscular problem, more support of the head may be indicated.

To supply that added support when necessary, a head support comprising a support member 22 and a pair of attaching arms 23 is provided. These attaching arms are formed with loops at the ends so that the support straps 20 can be run through the loop to hold the support member. The loops also allow the vertical position of the head rest to be adjusted to fit the location of the infant's head as he or she grows. Normally, at least at first, the support member 22 will be tucked inside the flap 17 to provide more comfortable support for the infant's head.

In use, the harness including the belt 10 and shoulder straps 11 are buckled in place. The infant's legs are then inserted into the openings 18. Then, as the infant is held in one arm, the flap 17 is pulled up behind the infant's back and the quick attachment buckles 14 on the support straps 11 are fastened to hold the infant in place. The loops on the arms 23 of the head support have previously been engaged around the support straps 20 and can now be adjusted to the proper position to support the head of the infant. Thus, the small infant is fully protected in the carrier. As the infant grows and attains the stage at which she or he can support her own head, the head support can be removed from the straps 20 and the carrier be used without the added support.

It may be noted that the use of this device is not limited to that of carrying the infant. It can be readily adapted to be used as a restraint to hold the infant in a grocery store cart or on a straight chair simply by adjusting the harness to fit the cart or the chair. The flap 17 and head support 22 still function in the same manner as when the infant is carried to support the body and head of the child in a near upright seated position.

I claim as my invention:

1. For use by a person carrying an infant with said infant's face toward said person, an infant carrier comprising a harness adapted to be worn by the person carrying the infant having a lower portion adapted to be positioned across the abdomen region of the person, carrier means attached to said harness adapted to support said infant wherein said carrier means includes a flap having one end secured to said lower portion and having holes therein adapted to receive the legs of said infant, said flap including a pair of support straps extending from the opposite end and are adapted to be releasably attached to said harness, and head support means comprising a band-like means having opposite ends and adapted to lie behind the infant's head, wherein said head support means extends between said support straps and includes a loop at each said end, said support straps being slidably received in each loop, respectively, whereby said head support means is adjustably positionable along said support straps so that said head is positioned between said head support means and said person, said head support means being removably attached to said carrier means and adapted to provide added support for the head of said infant.

2. The carrier of claim 1 in which said head support means is removably attached to said support straps.

* * * * *